United States Patent [19]

Butcher

[11] 4,078,705

[45] Mar. 14, 1978

[54] VALVES FOR PRESSURIZED DISPENSERS

[75] Inventor: Roger Anthony Butcher, Horndean, England

[73] Assignee: Aerosol Inventions & Development, S.A. Aidsa, Fribourg, Switzerland

[21] Appl. No.: 691,431

[22] Filed: Jun. 1, 1976

[30] Foreign Application Priority Data

Jun. 7, 1975 United Kingdom ..... 24549/75

[51] Int. Cl.[2] ..... B65D 83/00

[52] U.S. Cl. ..... 222/402.24

[58] Field of Search ..... 222/394–397, 222/402.1, 402.24; 239/372

[56] References Cited

U.S. PATENT DOCUMENTS 2,631,814 3/1953 Ablanalp ..... 222/320 X

*Primary Examiner*—Allen N. Knowles

*Attorney, Agent, or Firm*—Holman & Stern

[57] ABSTRACT

A valve assembly for a small hand-held pressurized dispenser, such as an aerosol can, comprising the known form of valve mounting cup provided with a boss having a top wall and a peripheral side wall, a valve housing located at least partially in the boss and carrying a spring-loaded valve member, and a gasket of a flexible, resilient material trapped between and forming a seal between a rim on the housing and the top wall. The assembly is distinguished by the feature of an annular step in the boss facing away from the top wall and a flange on the valve housing which engages against the step to define the distance between the rim and the top wall and thereby limit the sealing pressure applied to the gasket. The flange may be integral with the rim in which interruptions in the step form gassing paths for filling the dispenser, or alternatively the flange and rim are separate in which case discontinuities such as notches and perforations in the rim and flange form a gassing path.

10 Claims, 7 Drawing Figures

VALVES FOR PRESSURIZED DISPENSERS

This invention relates to an improved form of valve for small pressurised dispensers, such as those commonly known are aerosol cans.

The usual valves for this purpose employ a disc-like gasket of a flexible, resilient material such as rubber or synthetic rubber mounted against the underside of the horizontal top wall of a central upstanding boss in a sheet metal valve mounting cup, with a valve member having an annular surface urged against the lower face of the gasket by a spring, assisted by the pressure within the container. A hollow stem projects upwards through a central hole in the gasket and downward or tilting movement of the stem causes the annular surface of the valve member to move partially or bodily away from the gasket to provide an outlet path for the product through the stem. The valve member is enclosed in a housing that is mounted within the central boss of the mounting cup and is secured in place by inward crimping of that cylindrical wall of the boss. This crimping not only clamps the shell in place but also traps the periphery of the gasket between the rim of the housing and the underside of the top wall of the boss.

To fill the necessary propellant gas into the dispenser it would be possible, in theory, to pass the gas through the stem of the valve while the valve is held open but this would be unacceptably slow, due to the restricted orifice that is usually present in the stem. It is therefore more usual to pass the gas around the outside of the stem, allowing the inner edge of the gasket, where it fits around the gasket, to flex downwards away from the stem and provide a direct path in the valve housing around the valve member, and thence through the usual dip tube and into the product already in the dispenser. However even this restricts the rate of flow due to the length and small diameter of the tip tube and/or of the spigot onto which it fits on the valve housing; a further drawback in gassing through the dip tube arises where the propellent is carbon dioxide, nowadays used to an increasing extent, because it takes an appreciable time to dissolve in the product when admitted in small bubbles below the surface.

Proposals have therefore been made to provide a path for the gas that by-passes the valve housing. In U.S. Pat. No. 3,375,957 there is described an arrangement in which the gas flows over the rim of the housing and under the gasket. In practice it is found that even with the known method of filling, some of the gas passes above the gasket, i.e. between the gasket and the top wall of the boss, and then downwards over the periphery of the gasket and housing. In U.S. Pat. No. 3,158,287 to Ferry and in its U.S. Pat. of Addition No. 1,002,576 there are disclosed arrangements where the filling is wholly by such a path, the inner edge of the gasket remaining sealed to the stem, and the upper end of the valve housing is specially designed to facilitate this, by the provision of angularly spaced notches in its upper and outer faces. Other proposals have involved the provision of a ring of holes in the top wall of the boss, and in U.S. Pat. Nos. 3,319,669 to Abplanalp and U.S. Pat. No. 3,845,887 to Meuresch et al., assigned to Precision Valve Corporation there are disclosed arrangements in which the periphery of the gasket itself is scalloped or otherwise cut away to form a non-circular shape.

The chief aim of the present invention is to provide a further improvement in the way in which gassing is permitted through a path above and around the gasket. In particular it is an aim of the invention to provide a construction which allows easy assembly of such a valve on automatic machinery. A problem in the known constructions is that the gasket has to be correctly located in the mouth of the housing and this is not easy, especially where the valve is of the female type, i.e. with no protruding stem, or where, although of the male type, it has clearance around the stem.

According to the invention the boss of the mounting cup has an annular step facing away from the top wall and the housing has a flange which engages against the step to define the distance between the rim of the housing and the top wall and thereby limit the degree of compression of the gasket.

In a valve assembly embodying the invention when the usual crimp is applied to the outside of the boss, for example at eight equally spaced points, the flange on the housing is urged upwards but engages the step, the position of which is carefully selected in relation to the thickness of the gasket. Thus variations in the degree of crimping, which are inevitable and which is known designs produce variations in the degree of compression of the gasket, cannot result in excessive compression of the gasket. The flange may be formed as an integral part of the rim or it may be formed separately. Where they are separate the crimp may be applied below either the flange or the rim.

Preferably the rim is provided with an upstanding annular rib on its upper face to provide a concentrated local engagement with the gasket along a circular line. The rib may be of wedge-shaped cross-section and be placed at the inner edge of the rim.

The step may be interrupted at at least one point to provide a gassing path. There may be any desired number of interruptions and in a typical example the step is interrupted at four uniformly angularly spaced points, although the number could equally well be two, three, or even five or more. The provision of a gassing path or paths within the central boss of the sheet metal mounting cups means that one can use a straightforward round gasket with no scalloping, and a housing with a fully periphery. However gassing paths may alternatively or additionally be formed by notching the rim of the housing or the gasket or both and perforating the flange when separate from the rim.

Some embodiments of the invention will now be described, by way of example only, with reference to and as shown in the accompanying drawings, in which.

Figure 1:
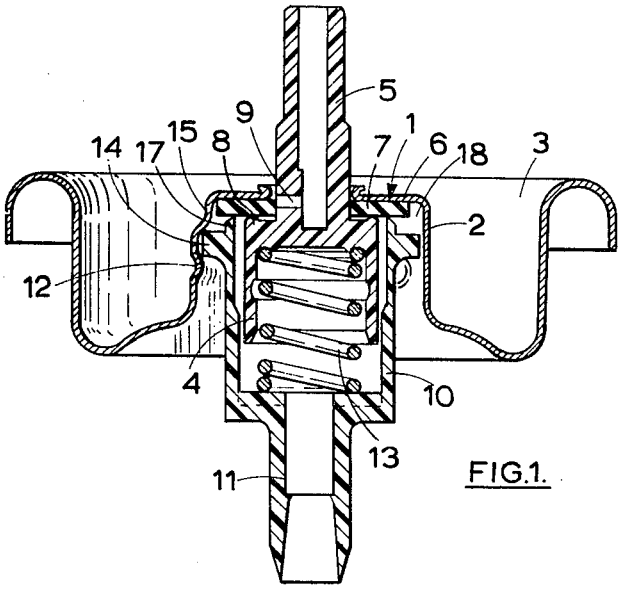
FIG. 1 is a view of a valve assembly sectioned along line A—A of FIG. 2.
Figure 2:
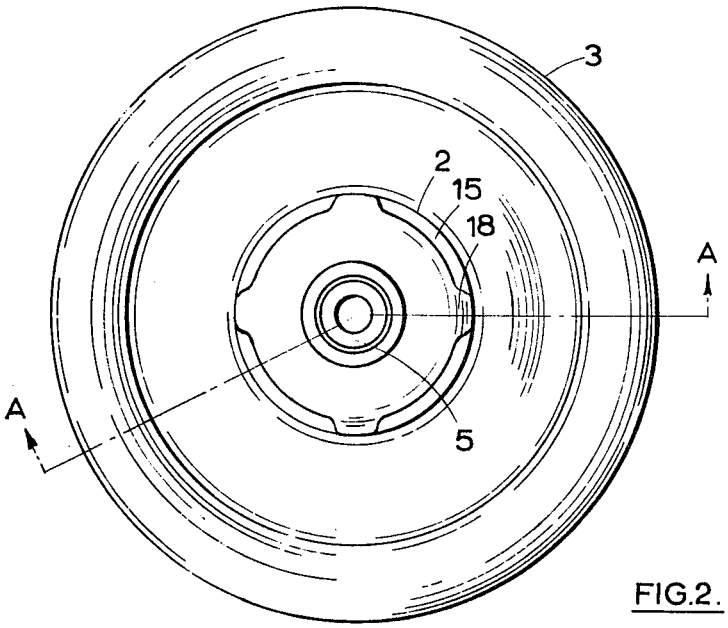
FIG. 2 is a plan view of the assembly.

The drawings show a valve assembly for a pressurised dispenser. The assembly comprises a valve 1 mounted in a central raised boss 2 of a sheet metal mounting cup 3 which is designed to fit onto a dispenser (not illustrated) in a manner that is well known. The valve 1 comprises a valve member 4 in the form of an inverted cup surmounted by an integral upstanding hollow stem 5. The stem 5 projects through a central hole in the top wall 6 of the boss and through a flat annular gasket 7 of a synthetic rubber located against the underside of the top wall. The central hole in the top wall 6 is a little larger in diameter than the stem 5 but the gasket 7 forms a tight sealing fit against the stem. An annular bead 8 formed on the outer edge of the upper face of the valve member 4 cooperates with the underside of the gasket 7 to form a seal. A radial hole 9 extends outwards through the wall of the hollow stem at a level which is just above the lower face of the gasket 7 when the bead 8 is sealed against the gasket. The valve is shown in its closed state. On downward movement of the valve stem 5 the seal formed by the bead 8 breaks and the radial hole 9 moves down relative to the gasket to open the communicate with the space below the gasket thus opening the valve and putting the hollow stem in communication with the interior of the valve.

The valve member 4 is enclosed in a hollow cylindrical housing 10. The internal diameter of the housing 10 is a little greater in diameter than the outer diameter of the valve member 4 so that a fluid flow path is formed through the housing passed the valve member although somewhat restricted. A hollow spigot 11, leading from the interior of the housing extends down from the lower end of the shell and can be fitted with the usual dip tube (not shown). The upper end of the housing 10 is open and seals against the underside of the gasket 7, the housing being retained in the boss 2 by crimping the boss around the housing as indicated at 12. A helical coil spring 13 is carried in the housing 10 to urge the valve member 4 upwards to seal the annular bead 8 against the gasket 7.

The valve assembly as so far described is basically of a known form and acts in a known manner. However in accordance with the invention the upper end of the housing 10 is provided with a rim 14 in the form of an outwardly extending radial flange which is of larger diameter than the rest of the housing and is positively located against a step 15 formed between the top wall 6 and side wall 16 of the boss 2. The rim 14 is retained in the boss 2 in contact with the step 15 by the crimping 12 of side wall 15 just beneath the rim so that the rim is trapped between the step and the crimp. the rim 14 also has an upstanding annular rib 17 at its inner edge. The rib 17 is wedge-shaped and tapers to a line at its upper edge to form a circular line-contact seal with the lower face of the gasket 7 which lies in the portion of the boss which is of reduced diameter owing to the presence of the step 15.

Figure 3:
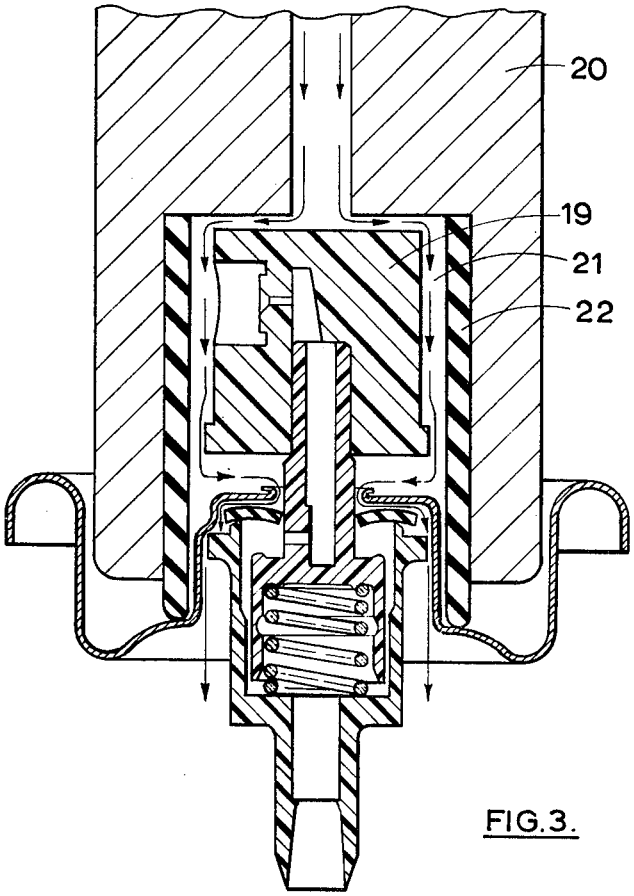
FIG. 3 is a view similar to FIG. 1 but showing the assembly engaged by a pressure filling head.
Figure 4:
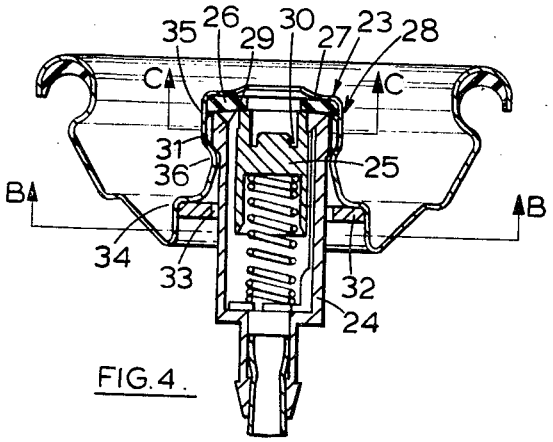
FIG. 4 is a view of another valve assembly sectioned on an axial plane.
Figure 5:
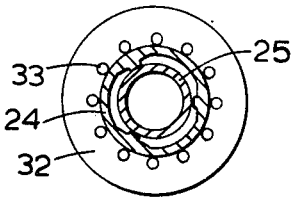
FIGS. 5 and 6 are sectional views on lines B—B and C—C respectively in FIG. 4.

The step 15 is interrupted at four equally spaced points around the boss 2 as shown at 18. During gassing of the dispenser to which the valve assembly is fitted the interruptions provide free flow paths to the space between the side wall 16 and the housing 10 and hence the interior of the dispenser for gas passing in between the top wall 6 and the gasket 7. The flow paths of gas entering the dispenser are shown by the arrows in FIG. 3. In FIG. 3 the valve assembly is shown connected to a high pressure gassing head 20 and with an actuating button 19 on the stem. The gassing head is in a simplified diagrammatic form only; it comprises a socket 21 lined with a rubber seal 22 which fits over the button 19 and the boss 2, depressing the button to open the valve and sealing against the mounting cup 3.

During filling a small amount of gas will pass into the hollow stem 5 and through the open valve into the container. Also a small amount will pass down the outside of the stem 5 to below the gasket and into the interior of the valve housing 10. However the total amount of gas passing into the dispenser via the interior of the valve is small compared with the amount flowing along the path outlined by arrows. This is due primarily to the provision of the interruption 18 in the step 15 and to control of the sealing pressure exerted on the gasket 7. Control of the sealing pressure is obtained by positive location of the rim 4 of the housing and is sufficiently close to ensure that under the injection pressure of gassing the gasket 7 is compressed to leave a flow path between the gasket and top wall 6 which is less restricted than other possible flow paths. It should also be noted that by virtue of the sealing load being concentrated at a single circular line by the provision of the wedge-shaped rib not only is a good seal provided at normal operating pressures of the dispenser but furthermore the inner and outer peripheries of the gasket 7 are free to flex down as much as possible during gassing to reduce the resistance to flow. Flow downwards between the side wall 16 of the boss and the housing 10 is kept free by making the outer diameter of the rim 14 a little less than the inner diameter of the boss and crimping at a number of points spaced around the boss, eight points for example, leaving free paths between adjacent crimp points.

After gassing the gasket 7 shown compressed in FIG. 3 will re-expand and reseal the housing 10 to the boss 2 as shown in FIG. 1, the internal pressure of a full dispenser being considerably less than the injection pressure of the gassing head. In previously known valves the crimp formed a composite sandwich of both the gasket and the rim, and owing to variations in the crimp wide variations in sealing pressure occured. In a valve embodying the invention the sealing pressure can be controlled sufficiently to ensure rapid filling and subsequent resealing when full.

The valve construction described also has the advantage that it is particularly suited to automatic assembly with the valve inverted; the gasket is dropped into the boss and is centrally located by the shoulder, into which it fits; the shell, after insertion of the valve member, is equally positively located by the main cylindrical part of the side wall of the boss.

Another assembly embodying the invention is shown in FIGS. 4 to 7. The assembly includes a valve 23 having a housing 24 in which there is a springloaded valve member 25 urged into sealing engagement with a gasket 26. The gasket 26 also forms a seal between the top wall 27 of the boss 28 and a rim 29 at the upper end of the housing 24. Thus the valve 23 is similar to valve 1 shown in FIG. 1 but differs in that the valve member 25 has a recess 30 in its upper end to receive a separate stem integral with an operating button (not shown).

Figure 6:
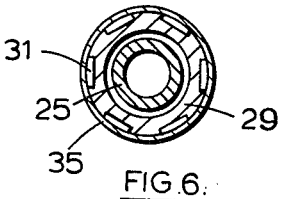

The rim 29 of the valve 23 is in the form of a thickening on the outide of the upper end of the housing 24. The outer edge of the rim 29 is notched as is shown at 31. As shown in FIG. 6 there are six equally spaced notches but fewer or more notches may be formed in the rim. The upper edge of the rim is tapered to form a line-contact seal against the gasket 26. Beneath the rim 29 and spaced therefrom there is an outwardly extending flange 32, the outer diameter of which is greater than the outer diameter of the rim 29. The flange 32 has a ring of perforations 33 formed in it adjacent to the wall of the housing 24. The flange 32 engages against an annular step 34 formed in the side wall 34 of the boss 28 somewhat nearer the bottom of the boss than the top. The engagement of the flange 32 with the step 33 positively locates the valve housing 24 in the boss and this controls the sealing pressure applied by the rim 29 to the gasket 26. The housing 24 may be retained in the boss by crimping the side wall 35 at a number of circumferentially spaced points between the rim 29 and the flange 32, two such crimps being shown at 36 in the plane of section of FIG. 4. Alternatively a crimp could be formed beneath the flange 32 to trap the flange between the step 34 and the crimp in a manner similar to the way in which the rim 14 in FIG. 1 is located.

Figure 7:
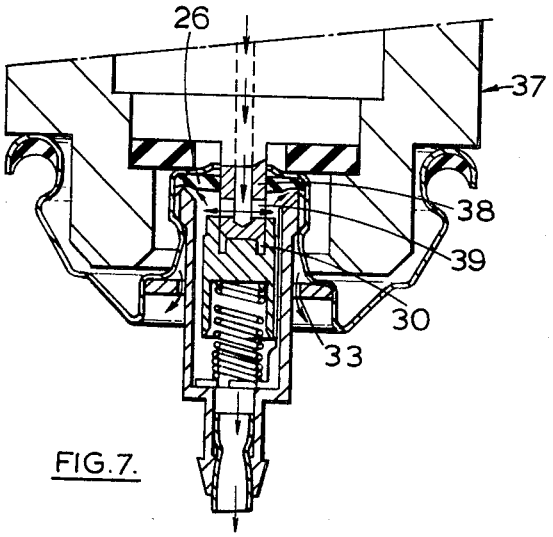
FIG. 7 is a view similar to FIG. 4 but showing the assembly engaged by a pressure filling head.

FIG. 7 shows the valve engaged by a filling head 37 which has a stem 38 passing through the gasket 26 and into the recess 30 in the top of the valve member to depress the valve member. The stem 38 has two radial holes 39 above the recess 30 but below the gasket 26 so that gas can be introduced into the valve housing 24 at high pressure. The pressure is sufficient to cause compression of the gasket 26 allowing gas to pass between the rim 29 and the gasket. The notches 31 in the rim 29, the spaces between crimps 36 and perforations provide a free path for gas flow down the outside of the housing. The flow of gas during gassing is indicated by arrows in FIG. 7. After gassing the pressure in the container to which the assembly is fitted is not sufficiently high to compress the gasket 26 and escape.

We claim:

1. A valve assembly for a pressurised dispenser comprising a valve mounting cup, a boss formed in said cup with a top wall and a peripheral side wall, a valve housing located at least partially in said boss and having a rim facing said top wall, a spring-loaded valve member in said valve housing and a gasket of a flexible, resilient material trapped between and forming a seal between said rim and said top wall, said peripheral side wall of said boss having a crimped region inwardly crimped to urge said housing upwards to cause said rim to trap said gasket against said top wall and thereby form a seal therewith; said valve member being spring loaded into engagement with said gasket, said boss has an annular step facing downwards away from said top wall, said step being independent of said crimped region, and said housing has a flange which engages directly against said step to limit the upward movement of said housing under the action of said crimped region and thereby to define the distance between said rim and said top wall whereby to limit the sealing pressure applied to said gasket.

2. A pressurised dispenser comprising a container having an opening, a valve mounting cup fitted in said opening, a boss formed in said cup with a top wall and a peripheral side wall, a valve housing located at least partially in said boss and having a rim facing said top wall, a spring-loaded valve member, in said valve housing and a gasket of a flexible, resilient material trapped between and forming a seal between said rim and said top wall, said peripheral side wall of said boss having a crimped region inwardly crimped to urge said housing upwards to cause said rim to trap said gasket against said top wall; said valve member being spring loaded into engagement with said gasket, said boss has an annular step facing downwards away from said top wall, said step being independent of said crimped region and said housing has a flange which engages directly against said step to limit the upward movement of said housing under action of said crimped region and thereby to define the distance between said rim and said top wall whereby to limit the sealing pressure applied to said gasket.

3. A valve assembly for a pressurised dispenser comprising a valve mounting cup, a boss formed in said cup with a top wall and a peripheral side wall, a valve housing located at least partially in said boss and having a rim facing said top wall, a spring-loaded valve member in said valve housing and a gasket of a flexible, resilient material trapped between and forming a seal between said rim and said top wall, and wherein said boss has an annular step facing away from said top wall and formed between said top wall and said side wall and said housing has an integral flange which engages against said step to define the distance between said rim and said top wall whereby to limit the sealing pressure applied to said gasket.

4. A valve assembly according to claim 3 wherein an interruption is formed in said step whereby a gassing path is provided.

5. A valve assembly according to claim 4 wherein interruptions are formed in said step at four equally spaced points around said boss.

6. A valve assembly for a pressurized dispenser comprising a valve mounting cup, a boss formed in said cup with a top wall and a peripheral side wall, a valve housing located at least partially in said boss and having a rim facing said top wall, a spring-loaded valve member in said valve housing and a gasket of a flexible, resilient material trapped between and forming a seal between said rim and said top wall, and wherein said boss has an annular step facing away from said top wall and said housing has a flange which engages against said step to define the distance between said rim and said top wall whereby to limit the sealing pressure applied to said gasket, discontinuities being formed in said rim and in said flange whereby a gassing path is provided.

7. A valve assembly according to claim 6 wherein said discontinuities comprise notches in the periphery of said rim and perforations in said flange.

8. A valve assembly for a pressurised dispenser comprising a valve mounting cup, a boss formed in said cup with a top wall and a peripheral side wall, a valve housing located at least partially in said boss and having a rim facing said top wall, a spring-loaded valve member in said valve housing and a gasket of a flexible, resilient material trapped between and forming a seal between said rim and said top wall, said rim including an annular rib which faces and makes sealing contact with said gasket, and wherein said boss has an annular step facing away from said top wall and said housing has a flange which engages against said step to define the distance between said rim and said top wall whereby to limit the sealing pressure applied to said gasket.

9. A valve assembly according to claim 8 wherein said annular rib is wedge-shaped and makes a line contact seal with said gasket.

10. A valve assembly for a pressurised dispenser comprising a valve mounting cup, a boss formed in said cup with a top wall and a peripheral side wall, a valve housing located at least partially in said boss and having a rim facing said top wall, a spring-loaded valve member in said valve housing and a gasket of a flexible, resilient material trapped between and forming a seal between said rim and said top wall, said valve housing being held in said boss by crimping said side wall at a number of discrete points, gassing paths lying between the crimp points, and wherein said boss has an annular step facing away from said top wall and said housing has a flange which engages against said step to define the distance between said rim and said top wall whereby to limit the sealing pressure applied to said gasket.

* * * * *